US006976343B2

(12) United States Patent
McGushion

(10) Patent No.: US 6,976,343 B2
(45) Date of Patent: Dec. 20, 2005

(54) COMPRESSIVE FLANGE SINUSOIDAL STRUCTURAL MEMBER

(76) Inventor: Kevin D. McGushion, 1448 19th St., Santa Monica, CA (US) 90404

( * ) Notice: Subject to any disclaimer, the term of this patent is extended or adjusted under 35 U.S.C. 154(b) by 0 days.

(21) Appl. No.: 10/421,075

(22) Filed: Apr. 24, 2003

(65) Prior Publication Data

US 2005/0210819 A1 Sep. 29, 2005

(51) Int. Cl.[7] ..... E04C 3/30

(52) U.S. Cl. ..... 52/729.3; 52/690; 52/694; 52/731.1; 52/309.13; 403/265; 403/404; 403/57

(58) Field of Search ..... 52/731.7, 730.6, 52/729.1, 690–694, 731.1–720.3, 309.13; 403/265–267, 403/404, 410, 384, 57

(56) References Cited

U.S. PATENT DOCUMENTS

| | | | | | |
|---|---|---|---|---|---|
| 101,015 | A * | 3/1870 | Holms | 52/729.3 |
| 2,029,645 | A * | 2/1936 | Waugh | 52/377 |
| 2,108,795 | A * | 2/1938 | Budd | 219/107 |
| 2,125,690 | A * | 8/1938 | Ragsdale et al. | 52/731.2 |
| 3,163,925 | A * | 1/1965 | Ulm | 29/893.32 |
| 3,300,839 | A * | 1/1967 | Lichti | 29/897.35 |
| 4,084,029 | A * | 4/1978 | Johnson et al. | 428/119 |
| 4,129,974 | A * | 12/1978 | Ojalvo | 52/729.1 |
| 4,251,973 | A * | 2/1981 | Paik | 52/729.1 |
| 4,597,278 | A * | 7/1986 | Hamada et al. | 72/187 |
| 4,734,146 | A * | 3/1988 | Halcomb et al. | 156/148 |
| 5,012,626 | A * | 5/1991 | Spelten | 52/729.3 |
| 5,417,022 | A * | 5/1995 | Ritchie | 52/309.13 |
| 5,600,932 | A * | 2/1997 | Paik et al. | 52/745.19 |
| 5,848,765 | A * | 12/1998 | Gillespie | 244/124 |
| 5,956,919 | A * | 9/1999 | McCracken | 52/729.3 |
| 6,415,577 | B1 * | 7/2002 | Curtis | 52/729.3 |
| 6,520,706 | B1 * | 2/2003 | McKague et al. | 403/265 |
| 6,550,211 | B2 * | 4/2003 | Kergen | 52/729.2 |
| 6,718,713 | B2 * | 4/2004 | McKague et al. | 52/309.13 |

* cited by examiner

*Primary Examiner*—Carl D. Friedman
*Assistant Examiner*—Yvonne M. Horton
(74) *Attorney, Agent, or Firm*—Aaron McGushion

(57) ABSTRACT

A sinusoidal structural member having a dual component flange is provided. In the preferred embodiment, the flange (both upper and lower) is comprised of at least two components. These two components can be produced by dividing the flange lengthwise; where the division plane is substantially parallel to the plane of the web, when observing a standard flange-web relationship; and the geometry of the division border substantially matches the sinusoidal geometry of the web. The two resulting flange components substantially complement one another; wherein the sine peak of one component fits within the sine valley of its corresponding component, leaving a gap sufficient to accommodate the thickness of the web to be interposed. The sinusoidal web, substantially matching the division pattern of the flange components, is compressively sandwiched between the flange components, with sufficient compression to bring the sinusoidal web within dimensional compliance. The flange components are fused to the sinusoidal web during the compression process. The resulting structural member simpler to manufacture, while still providing the strength to weight ratio required in many applications.

9 Claims, 3 Drawing Sheets

COMPRESSIVE FLANGE SINUSOIDAL STRUCTURAL MEMBER

BACKGROUND

1. Field of Invention

This invention relates generally to an improved structural member, and more particularly, to a structural member having a non-planar web. Still more particularly, the present invention relates to a sinusoidal structural support beam for aircraft and other lightweight, high-strength applications.

2. Description of Prior Art

In the aircraft industry, it is common to utilize I-beam like structural members having a sinusoidal web extending normally between a top and bottom flange. The generally sinusoidal shape of the web provides increased strength to weight performance, improved stiffness, and decreased volume. In order to accommodate the aircraft wiring harness, hydraulic and fuel lines, as well as immediate strength and volume requirements, the geometry of the web may vary from sinusoidal to planar, creating a potentially non-repeating web corrugation pattern.

Currently, structural members are generally constructed from metal or composite materials. With either choice of material, the construction of a structural member with a sinusoidal web is a challenge, in maintaining quality, tolerances, and minimizing costs. With the high cost of manufacturing composite structural members, due to the labor intensive techniques utilized, it is at times more economical and practical to use metals, such as titanium and aluminum, to construct sinusoidal structural members, when the design allows for it.

Because the sinusoidal web structural member cannot be extruded, like common I-beams, the web and flanges generally must be constructed as separate parts, and then attached, with the web communicating normally between the upper and lower flange. When using metal, it is a common practice to weld or fuse the flanges to the web. The welding device can be TIG, arc, plasma, laser, electron beam or any other effective fusing device. Other methods, using fusing materials such as solder and epoxy are also utilized.

To construct the sinusoidal web, it is common to use a roll former or other similar device to create the desired corrugated pattern. Certain materials, such as titanium alloy 6-4, have considerable spring-back properties, making them relatively difficult to roll form to the tight tolerances required in the aerospace industry. Because the structural integrity, stability, and fit of the sinusoidal beam rely on maintaining the proper tolerance, it is important to implement a method or device to forcibly compress the sinusoidal web into compliance. This is commonly achieved through a clamping means.

In certain industries, such as construction, sinusoidal or trapezoidal structural beams are also utilized. One such beam disclosed in U.S. Pat. No. 6,415,577 to Curtis, describes a generally trapezoidal web extending between an upper and lower rectangular tube. The web is fastened, welded, or otherwise fused to the flange surface contacting the web edge, on both the upper and lower flange. The weld bead lies in the corner formed between the flange and web surfaces. This weld bead can be either continuous along the entire length of the beam or intermittent. With this method, it is difficult to maintain the dimensional tolerances required for the aviation industry. Because the welder requires access to the entire length of the beam, a comprehensive rigid clamping means to maintain tight tolerances may not be practical, due to interference between the clamping means and the welding device.

It is also a common practice in industry to utilize a clamping means to maintain the desired tolerance, while welding from the outer surface of the flange, through the flange, and into the top edge of the sinusoidal web, for both the upper and lower flanges. This manufacturing technique accommodates the tight tolerancing required for many aerospace and high technology applications. However, while holding the web and flanges firmly in place, the clamping means tends to block off access to the web and inner surfaces of the upper and lower flanges. Therefore, the only surface exposed to the welding device is the outer surface of the flange. Because the sinusoidal shape of the web edge is not entirely visible or accessible while secured in the clamping fixture, the weld must be created solely on the expected position of the web edge at any given point, and not necessarily the actual position, creating a blind weld situation. When dealing with the thin gauge metal required for lightweight applications, it is difficult to guarantee that the weld bead will fully penetrate the flange and the sinusoidal web edge at every given point along the length of the beam, using this blind method. Even when using a computer programmed path for the welding device, it is difficult and costly to produce the required bond between the flange and web, due to the slightly unpredictable nature of sinusoidally formed sheet metal webbing. Also, the clamping means cannot be in close contact with the weld area to maintain the position of the web, for fear of interfering with the weld.

What is needed is an economical sinusoidal structural beam and manufacturing method that can maintain the tight tolerances required for items such as wing spars and floor beams in aerospace and other high strength, low weight applications.

SUMMARY OF THE INVENTION

In accordance with the present invention, an accurate and economical sinusoidal structural member and manufacturing method thereof is provided. In the preferred embodiment, the flange (both upper and lower) is comprised of at least two components. These two components can be produced by dividing the flange lengthwise; where the division plane is substantially parallel to the plane of the web, when observing a standard flange-web relationship; and the geometry of the division border substantially matches the sinusoidal geometry of the web. The two resulting flange components substantially complement one another; wherein the sine peak of one component fits within the sine valley of its corresponding component, leaving a gap sufficient to accommodate the thickness of the web to be interposed.

Unlike the sinusoidal web, the flange components can be easily machined to the desired sine shape or other shape, using common machining techniques known to those familiar to the art, such as a CNC milling or water jet cutting. Therefore, the shape of the corrugation on the flange components is significantly more accurate than the sinusoidal web. So, the more flexible sinusoidal web can be brought into dimensional compliance with the significantly stiffer flange components.

The sinusoidal web, substantially matching the division pattern of the flange components, is compressively sandwiched between the flange components, with the edge of the sinusoidal web being substantially flush with the outer surface of the flange components, or protruding above the surface of the flange, opposite the web, so as to provide a consumable rib for the welding process. A relatively simple clamping means can be utilized to compress the sinusoidal web between the two flange components. Minor dimensional inaccuracies, normally found in the sinusoidal web, can be corrected and brought within the tolerances designated in the design by this compression process. While under compression, the web and the flange components are welded or otherwise fused together, from the outer surface of the flange assembly. The intensity of the weld arc, when using TIG welding, can be adjusted to completely penetrate the full depth of the flange thickness, fusing each flange component to the sinusoidal web, with maximum contact between the fusion surfaces. Flange assemblies can be welded to both the upper and lower edges of the sinusoidal web, using the aforementioned technique, forming a complete sinusoidal beam.

Being visible from the outer surface of the flange assembly, the weld path can be easily followed and visually verified. In addition, because the two flange components sandwich the sinusoidal web, and bring it into dimensional compliance, generally the exact location of the seam path to be welded is known for every given point, and can be programmed into an automated welding device.

After the welding process, the weld bead can be visually verified to guarantee complete seam coverage and penetration. Upon passing the visual inspection, non-destructive techniques, such as x-ray, eddy current inspection, or dye penetrant, can be employed to verify the integrity of the weld seam.

Although not a preferred embodiment, another method that may be used to firmly position the sinusoidal web in relation to the flange. Instead of a two-part flange design, a narrow groove is formed in a single part flange. The narrow groove follows the exact sinusoidal path desired. The edge of the sinusoidal web is then forced into the groove, bringing it into dimensional compliance; and clamped into place with a clamping means. As in the previous method, the web is welded to the flange, from the upper surface of the flange, through the flange and into the edge of the sinusoidal web. The same process is repeated for the opposing flange.

DESCRIPTION OF THE PREFERRED EMBODIMENT(S)

The detailed description set forth below in connection with the appended drawings is intended as a description of presently-preferred embodiments of the sinusoidal structural member 27 of the present invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
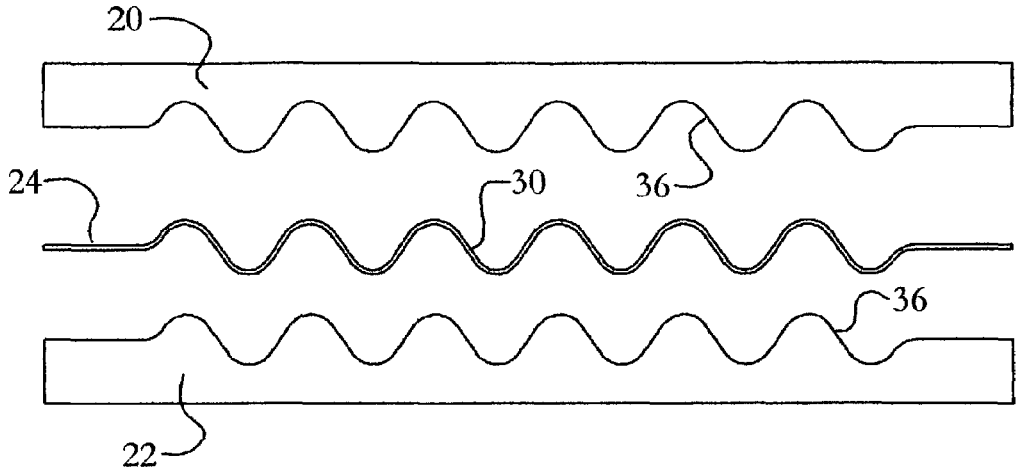
FIG. 1 is an exploded top view of the flanges and web components used to form the sinusoidal structural member of the present invention.
Figure 2:
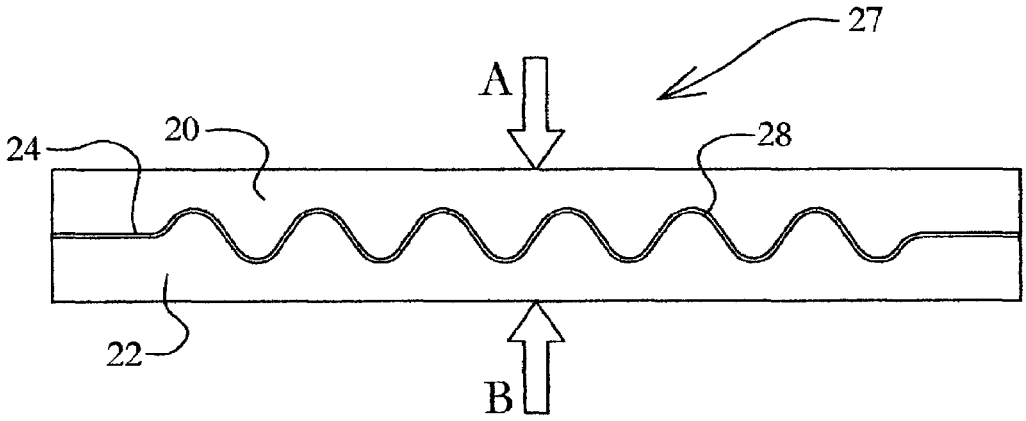
FIG. 2 is a top view of the sinusoidal structural member assembly in the clamped configuration, with the arrows indicating the general direction of the clamping force.
Figure 4:
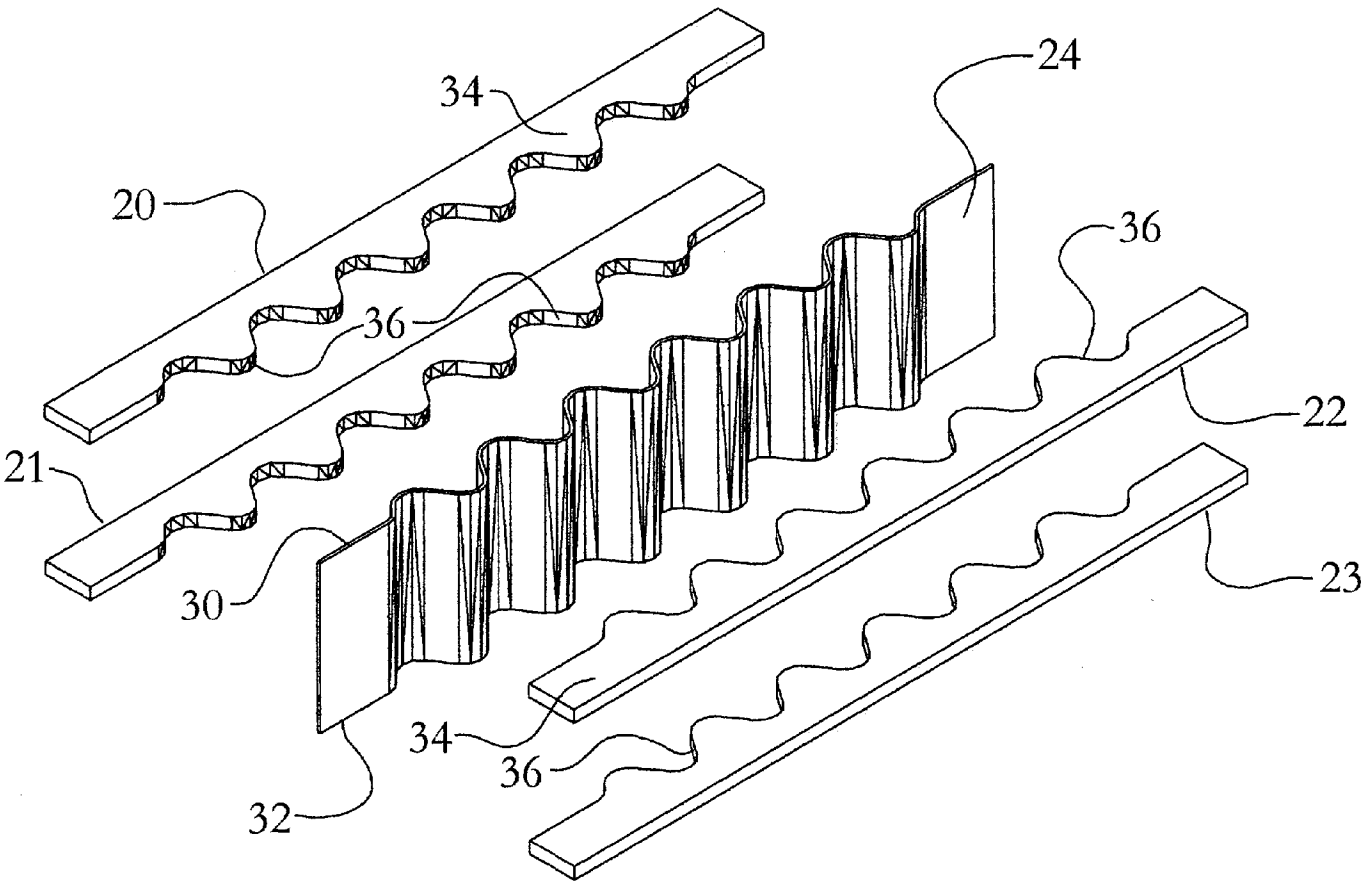
FIG. 4 is an exploded perspective view of the flanges and web components used to form the sinusoidal structural member of the present invention.

FIGS. 1 and 4 together illustrate the primary components required to manufacture a sinusoidal structural member 27 (FIG. 2) of the present invention. The sinusoidal web 24 usually has a substantially non-planar shape, closely resembling a sine wave function, when viewed from the top. However, the actual shape of the sinusoidal web 24 may vary depending on the application. The shape can vary from planar to any combination of planar and curvilinear, again when seen from the top view of FIG. 1.

The top left flange 20 and the top right flange 22, each have one sinusoidal edge 36 that substantially complement the sinusoidal shape of the sinusoidal web 24. These sinusoidal edges 36 can be machined to the exact tolerance required by the design. The complementary relationship of the top left flange 20, top right flange 22, and the sinusoidal web 24 can best be seen in FIG. 2. The arrows A and B represent a clamping force compressing the sinusoidal web 24 between the top left flange 20 and the top right flange 22. The clamping force can be created by clamps common to those familiar with the art. The flange upper surface 34 of the top left flange 20 and the top right flange 22 is below or substantially coplanar with the web top edge 30, during the clamping process.

When the compressive force, represented by arrows A and B, is applied to the top left flange 20 and the top right flange 22, the highly accurate sinusoidal edges 36 tends to force the less accurate sinusoidal shape of the sinusoidal web 24 into dimensional compliance. While being firmly clamped into position, a welding means, common to the art, is utilized to fuse the sinusoidal web 24 to the top left flange 20 and the top right flange 22, the fusion process starting from the flange upper surface 34, fusing the sinusoidal web 24 to the full thickness of the sinusoidal edge 36 of the top left flange 20 and the top right flange 22. The resulting weld seam 28 follows the sinusoidal path formed between the sinusoidal web 24 and the top left flange 20 and the top right flange 22. Similarly, the bottom left flange 21 and the bottom right flange 23 can be welded to the opposing edge of the sinusoidal web 24, with the flange upper surface 34 of the bottom left flange 21 and the bottom right flange 23 being substantially coplanar with the web bottom edge 32. Both the web top edge 30 and the web bottom edge 32 can be welded to their respective flanges simultaneously.

Figure 3:
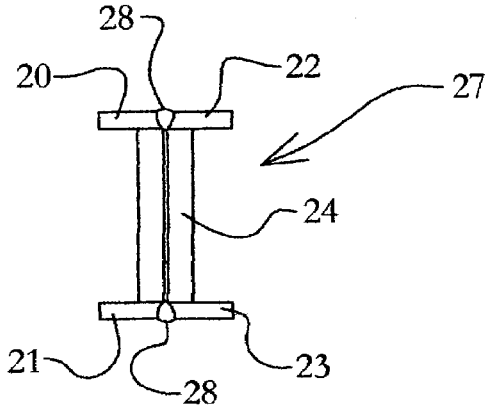
FIG. 3 is an end view of the welded sinusoidal structural member of the present invention.
Figure 5:
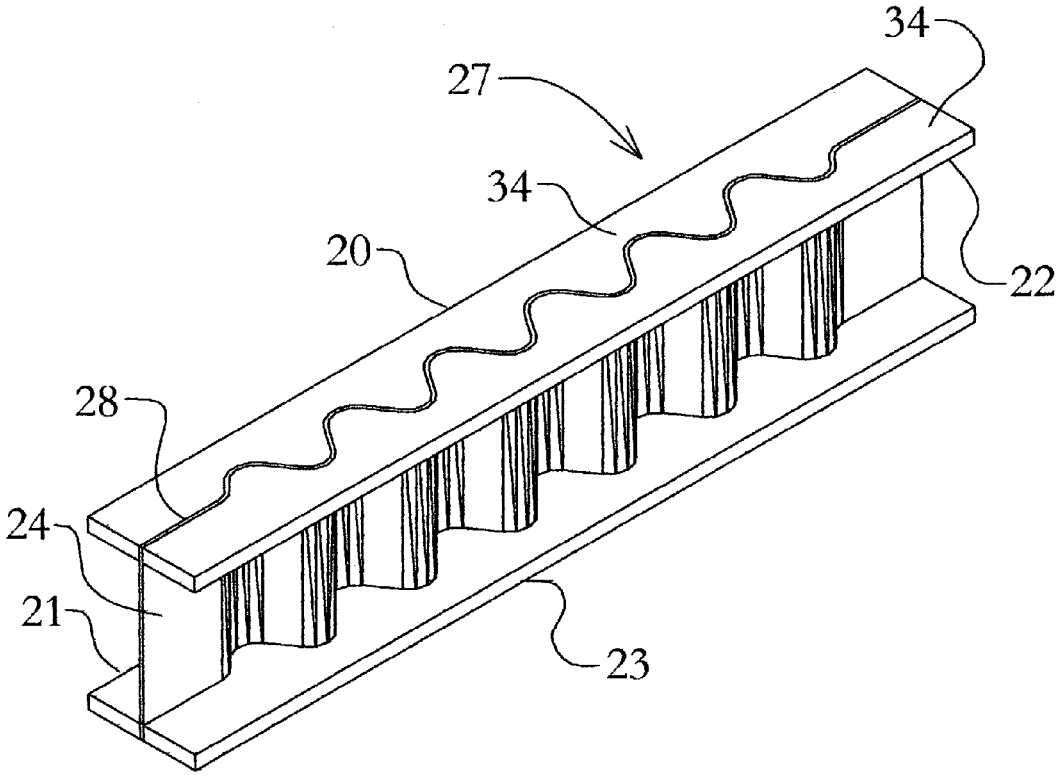
FIG. 5 is a perspective view of the completely assembled sinusoidal structural member of the present invention before the welding process.

The completed sinusoidal structural member 27 can be seen best in FIGS. 3 and 5. The weld seam 28 can be visually verified, to insure complete fusion of the seam. Additionally, the weld seam 28 can be inspected using methods common to the art, such as eddy current inspection, x-ray inspection, or dye penetrant.

Although the preferred embodiment of the invention has been illustrated and described, various changes can be made therein without departing form the spirit or scope of the invention.

What is claimed is:

1. A metal structural element, comprising:

a flexible web with a curvilinear profile;

a substantially rigid flange having a first component and a second component, the first component and the second component each having a longitudinal curvilinear edge, the longitudinal curvilinear edge of the first component being substantially complementary to the longitudinal curvilinear edge of the second component;

wherein the first component and the second component are substantially more rigid and have substantially higher dimensional accuracy than the flexible web;

and wherein the flexible web is compressively interposed between the longitudinal curvilinear edge of the first component and the longitudinal curvilinear edge of the second component, causing the flexible web to be further formed, increasing the dimensional accuracy to substantially match there higher dimensional accuracy of the longitudinal curvilinear edge of the first component and the second component;

and wherein the first component, the second component, and the flexible web are fused together while under compressive force, along the longitudinal curvilinear edges.

2. The metal structural element of claim 1 wherein the flexible web communicates between a top rigid flange and a bottom rigid flange.

3. The metal structural element of claim 1 wherein the longitudinal curvilinear edges of the first component and the second component are sufficiently offset in relation to each other to allow the flexible web to be interposed.

4. The metal structural element of claim 1 wherein the curvilinear profile of the flexible web varies from linear to curvilinear and the longitudinal curvilinear edge of the first component and the longitudinal curvilinear edge of the second component are substantially similar to the curvilinear profile of the flexible web.

5. The metal structural element of claim 1 wherein the flexible web and the rigid flange metal is a titanium alloy.

6. The metal structural element of claim 1 wherein the flexible web and the rigid flange metal is an aluminum alloy.

7. A method of forming the metal structural element of claim 1, comprising the steps of:

interposing the flexible web between the first component and the second component, forming a rigid flange assembly;

compressing the rigid flange assembly with an opposing clamping means, acting directly on the first component and the second component, adequate to form the flexible web and eliminate gaps formed between the first component, the flexible web, and the second component, causing the flexible web to be formed into a more dimensionally accurate shape, and;

welding the flexible web to the first component and the second component while under compression, along the longitudinal curvilinear edges.

8. The method of forming the metal structural element of claim 7 wherein the top rigid flange and the bottom rigid flange are fused to the web substantially simultaneously.

9. The method of forming the metal structural element of claim 7 wherein a fusing apparatus follows the path of the undulating planar profile of the flexible web during the fusing process.

* * * * *